US005779508A

United States Patent [19]

Pettesch et al.

[11] Patent Number: 5,779,508

[45] Date of Patent: Jul. 14, 1998

[54] ANTICLOGGING WATER JET CRAFT

[76] Inventors: Martin C. Pettesch, 3 Cayuga Rd.; Donald Eckloff, 8 Chippewa Way, both of Cranford, N.J. 07016

[21] Appl. No.: 822,315

[22] Filed: Mar. 21, 1997

[51] Int. Cl.[6] ..... B63H 11/01

[52] U.S. Cl. ..... 440/46

[58] Field of Search ..... 440/38, 46, 47; 60/221, 222

[56] References Cited

U.S. PATENT DOCUMENTS

| | | | |
|---|---|---|---|
| 3,040,695 | 6/1962 | Austin | 440/46 |
| 3,253,567 | 5/1966 | Patton, Jr. | 440/46 |

FOREIGN PATENT DOCUMENTS

| | | | |
|---|---|---|---|
| 65490 | 3/1991 | Japan | 440/46 |
| 867783 | 10/1981 | U.S.S.R. | 440/38 |

*Primary Examiner*—Ed L. Swinehart

*Attorney, Agent, or Firm*—Edward Dreyfus, Esq.

[57] ABSTRACT

A water jet ski or boat that prevents weeds or grass from entering or clogging the intake grate area, is simple in construction and installation, operates automatically without operator intervention, and allows the craft to be beached and refloated without damaging the anticlogging elements or the craft. The craft includes one or more, preferably two or four, flexible rods mounted at the forward end of the intake grating and depending downward and preferably rearward. Growing or floating weeds or grass encountered during forward movement of the craft will be forced by the rods downward, rearward, and, in one alternate embodiment, outward. The rods do not interfere with the laminar water flow from any direction into the intake and are flexible enabling the craft to be stored, trailered, beached and pulled back from the beach as desired and without damage.

16 Claims, 10 Drawing Sheets

ANTICLOGGING WATER JET CRAFT

BACKGROUND

The present invention relates to water jet crafts or vessels commonly known as water jet skis and water jet boats and more particularly to such craft with anticlogging intakes.

Conventional jet skis and jet boats include a large water intake opening at the boat bottom to direct large water flows through the pumping and jet system. Normally, grates are provided across the area ahead of the intake to discourage sticks and other debris from entering the intake. See U.S. Pat. No. 5,577,941; U.S. Design Patent D366444; and U.S. Reissue Patent RE35351. A problem exists with floating sea grass and shallow water weeds being sucked toward the intake which accumulate at the grate or within the jet pump housing causing blockage or restriction of the water flow through the jet system. This blockage can shut down the jet flow causing the craft to stop dead in the water. Eventually, the water cooled engine will overheat causing engine damage or shut-off. The operator must dismount and reach under the floating craft to try to dislodge the weeds, a quite dangerous and time consuming process.

Several known devices are purported to solve the above problem. One known device designed to enable the operator to remove weeds without dismounting from the craft includes a pair of opposed plastic hands with inward facing fingers connected by a cord. Other cords are attached to the outer sides of each hand. Upon fouling, the hands are thrown under the craft with the outer cords suspended from both port and starboard craft sides. One cord and then the other cord is raised to work the hands across the intake which purports to cause the fingers to remove the lodged weeds. In reality, the weeds are normally lodged well into the intake and beyond the grate. The device is useless with respect to those weeds.

The second known unit which is designed for jet boats is called C-Weeder™ Sport Jet Intake System by Overton. This grate type unit is designed for jet boats and not for personal water craft. The unit includes a rigid plate with baffles. It is purported that the baffle and plate prevents the weeds from entering the intake. This unit simply restricts water intake from below and causes all intake flow to be horizontal. Once weeds are sucked to block the horizontal openings, the unit will stop as described above. Also, since this prior device is made of rigid materials it would be damaged when the craft is beached and withdrawn from the beach.

Another known unit is made for jet boats and is factory installed. The unit resembles a pitch fork mounted on a hinge. When weeds lodge in the intake, the operator lowers the fork which purportedly dislodges the weeds from the grate. This is accomplished by means of a handle that is mounted inside the boat. Pulling the handle causes the fork to come down. The fork itself is a ridge casting. This unit is not intended to prevent weeds from entering the intake, but merely serves as a device to remove the weeds after they are lodged in the intake grate. The device is useless for weeds lodged beyond the grate.

Accordingly, there is a need for an improved anticlogging water jet craft that prevents weeds from entering the grate area, is simple in construction and installation, operates automatically without operator intervention, and allows the craft to be beached and refloated without being damaged or damaging the craft.

SUMMARY OF PREFERRED EMBODIMENT OF THE INVENTION

A preferable exemplary embodiment of water jet craft according to the principles of the present invention solves the foregoing problems, meets the foregoing objective, and provides other benefits by including one or more, preferably two or four, flexible rods mounted at the forward end of the intake grating and depending downward and preferably rearward. Growing or floating weeds or grass encountered during forward movement of the vessel will be forced downward, rearward, and in one embodiment outward by the rods. The rods do not interfere with the laminar water flow from any direction into the intake and are flexible enabling the vessel to be beached and pulled back from the beach as desired and without damage.

Other and further advantages and benefits of the present invention will be understood from the following detailed description of exemplary embodiments when taken in view of the appended drawings in which.

DETAILED DESCRIPTION OF EXEMPLARY EMBODIMENTS

Figure 1:
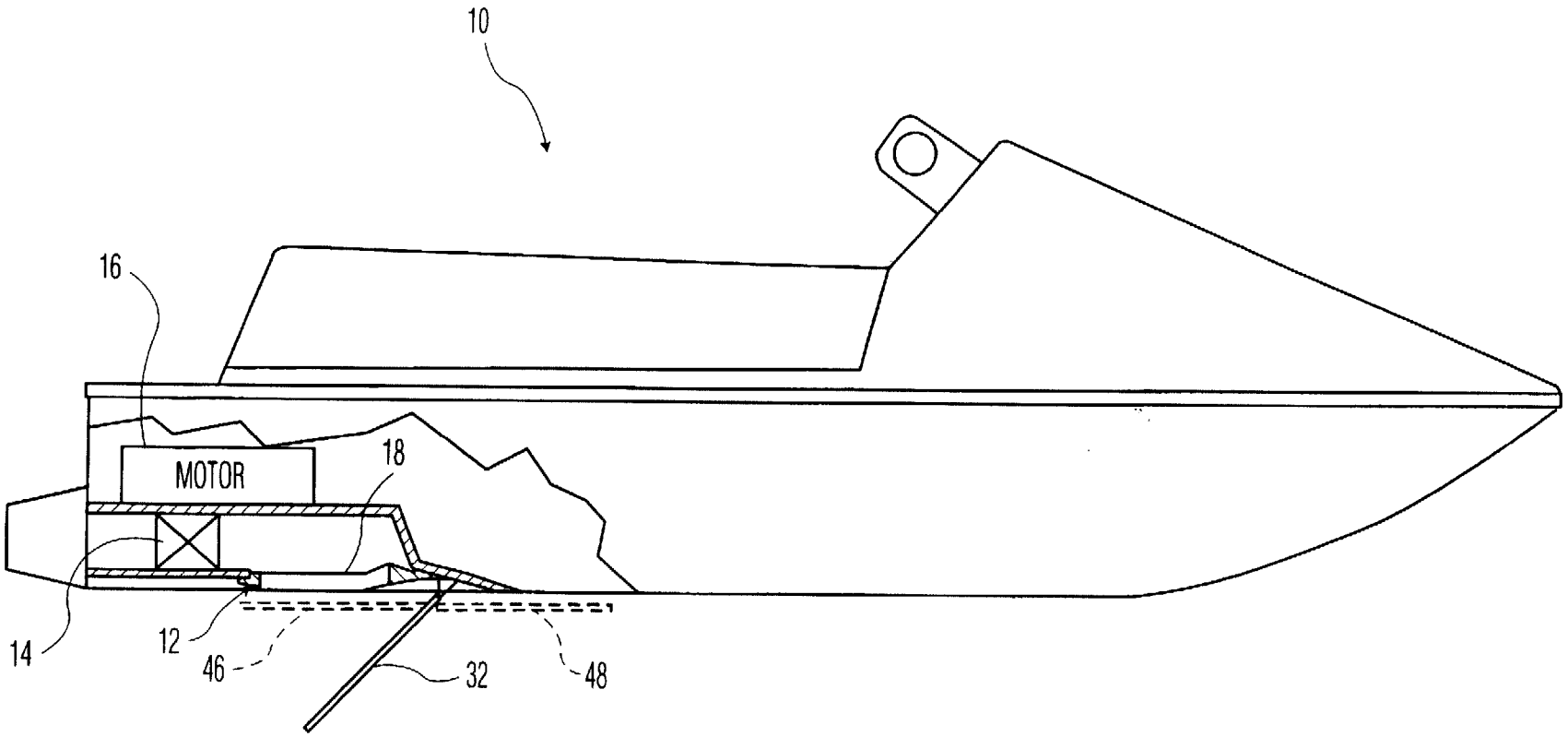
FIG. 1 is a pictorial side view of an exemplary embodiment of a watercraft according to the principles of the present invention with parts broken away.

With references to FIGS. 1–6, a jet ski 10 according to the principles of the present invention includes a water intake opening 12 located in the ski bottom which opening communicates with pump and pump housing 14 driven by motor 16. A conventional grate 18 extends across opening 12 and has its forward end 20 secured to the boat bottom by two bolts 22, and its aft end 24 secured to the boat bottom by two bolts 26. Grate 18 functions to enable water flow through opening 12 and block large objects that may damage the pump such as sticks, cans, bottles and other debris.

At least one anticlogging device and in the present exemplary embodiment two anticlogging devices 30 are mounted to the forward end of grate 18 and function to prevent weeds or grass from entering opening 12 as described below. Each device 30 includes an elongated, flexible rod 32 and a rod mount 34 that can include a flange 36 or other suitable shape secured to the forward end 20 of grate 18. The single bolt 22 can secure both flange 22 and end 20 to the craft bottom 38 generally as shown. Alternately, separate bolts (not shown) can secure end 20 and flange 36 directly to craft bottom 38. Another possibility (not shown) is to form grate 18 and mount 34 as a single manufactured piece or weld mount 34 to grate 18 during the manufacturing process or thereafter.

Mount 34 and rod 32 can be made of any number of suitable materials such as aluminum, steel, copper or other metals or alloys. Mount 34 could also be formed of hard plastic and rod 32 of flexible plastic or rubber, if desired. In one preferred example, mount 34 is formed of stainless steel, bright polished for good appearance, and rod 32 is formed of stainless steel flexible cable.

Figure 2:
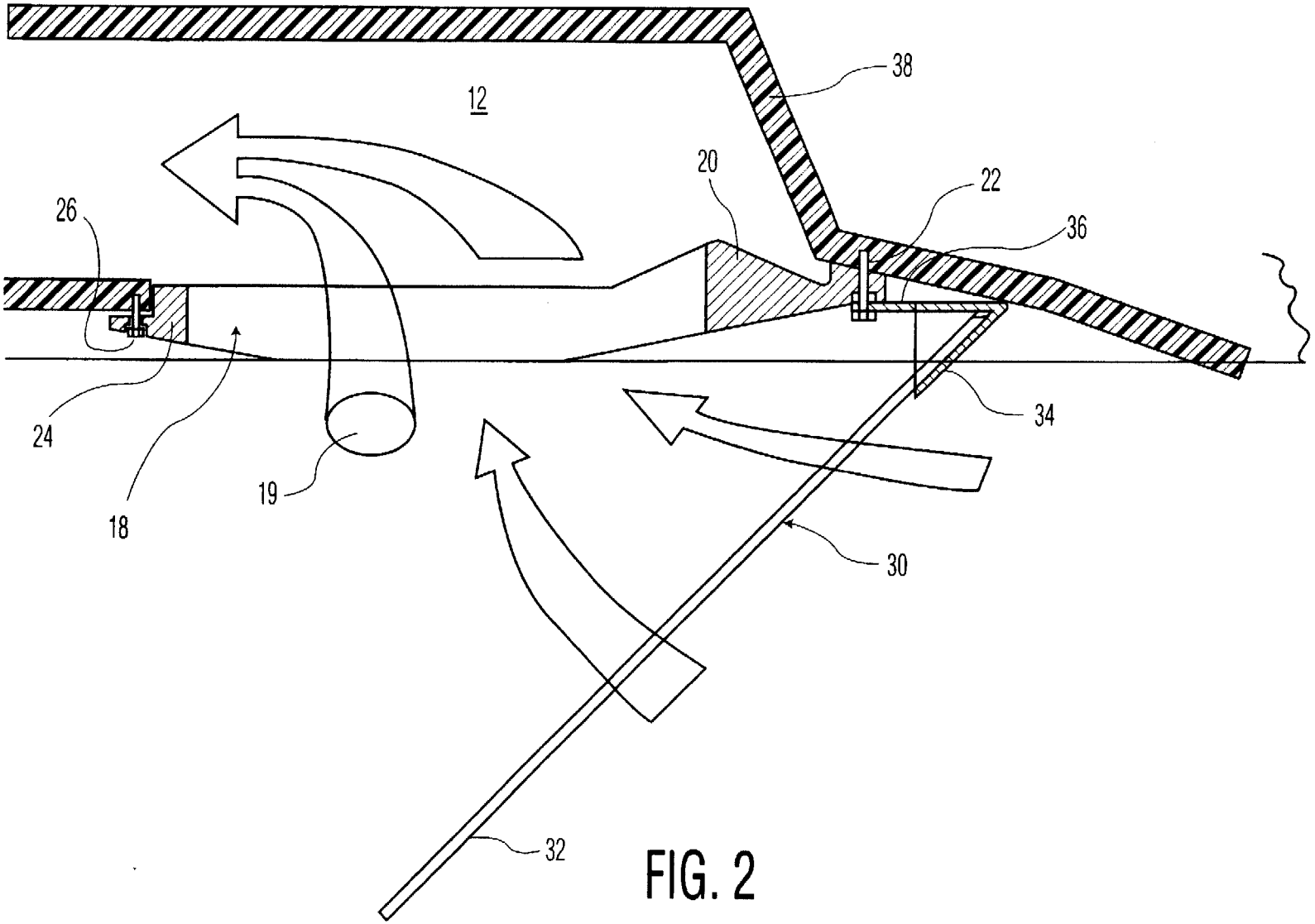
FIG. 2 is an enlarged side section of the intake portion of the craft of FIG. 1 and taken along line 2A of FIG. 6.
Figure 3:
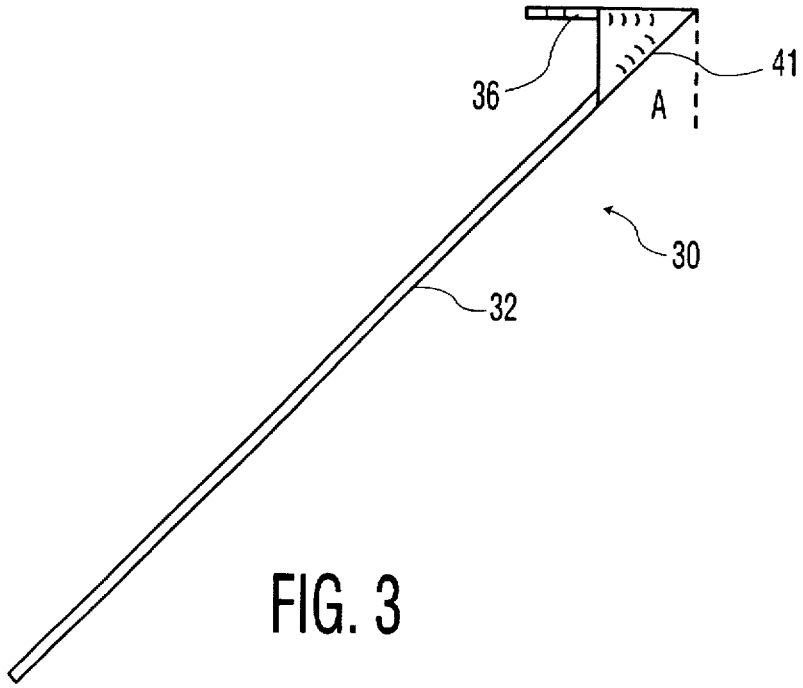
FIG. 3 is a side view of the anticlogging device of FIG. 2.
Figure 4:
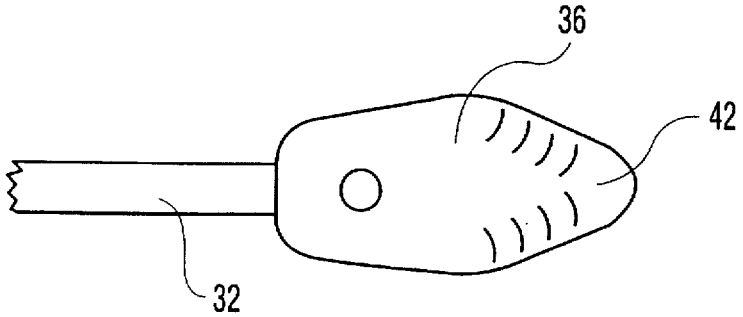
FIG. 4 is a partial top view of FIG. 2.
Figure 5:
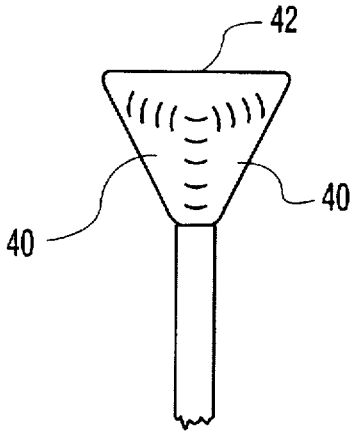
FIG. 5 is a partial front view of FIG. 2.
Figure 6:
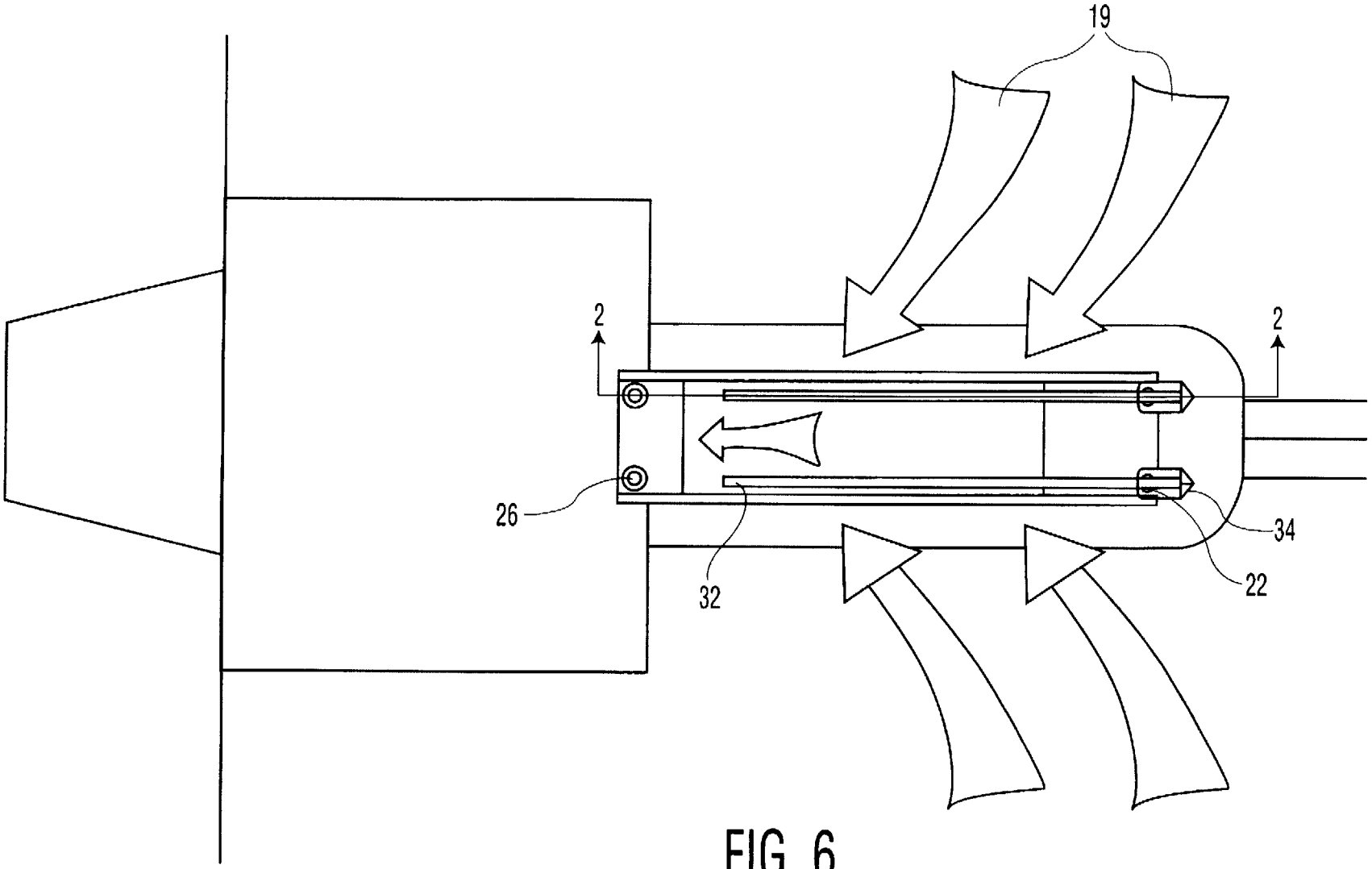
FIG. 6 is a partial bottom view of FIG. 1.

As better seen in FIGS. 2–5, mount 34 includes two depending sidewalls 40 and a top wall 42 integral with flange 36. These walls form an internal mounting cavity for insertion of the upper end of rod 32 which is welded to the intersecting inner surfaces of walls 40. See FIG. 2. In one example, for a 12 to 14 inch long grate, rod 32 is 16 inches in length with one inch of rod 32 welded inside mount 34. The angle "A" of the intersection 41 and the vertical plane seen in FIG. 2 is selected to determine the desired angle of dependency of rod 32 in relation to the length, diameter, and flexibility of rod 32 given the desired function of suppressing weeds and grass both floating and growing under various craft speeds and to permit beaching of the craft and dragging the craft backward without damaging the craft bottom or the devices 30. In this example, the arrangement of FIGS. 1–6 included stainless steel mounts 34 with angle A equal to 45 degrees, and rod 32 being a stainless steel cable or strand core wire rope with one inch welded in mount 34 and 15 inches exposed with a diameter of 3/16 inches and 47000 pounds of break strength to provide spring action forces. The stranded cable was fusion cut to prevent the strands from unraveling.

Figure 14:
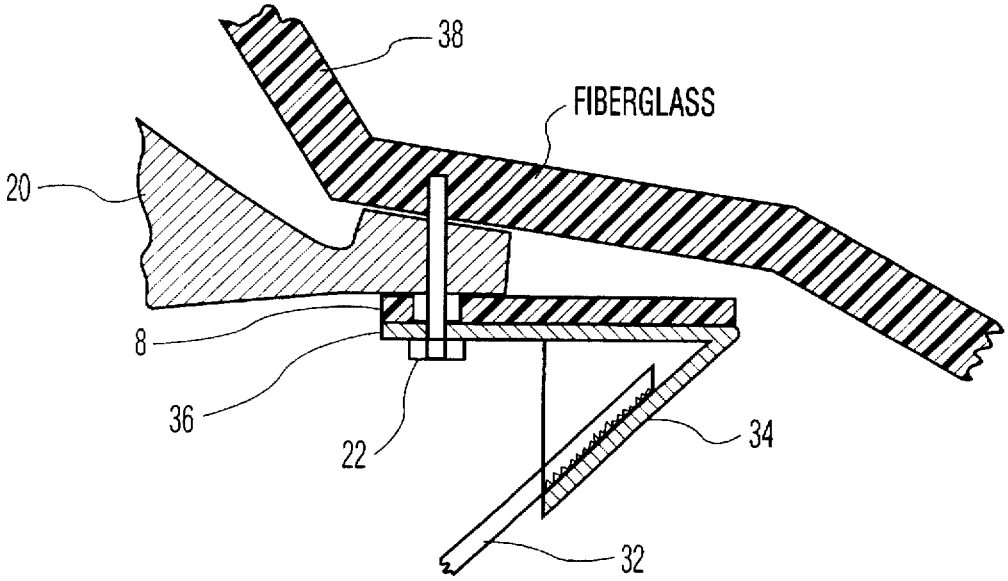
FIG. 14 is similar to FIG. 2 showing another embodiment of the anticlogging arrangement.

If desired or necessary, a rubber or other suitable material spacer 8, see FIG. 14, can be adhesively secured to flange 36 to protect mount 34 from contacting the fiberglass hull and to absorb shock and vibration energy that would tend to loosen bolt 22 from the assembly. Spacer 8 can have any suitable shape so long as it surrounds bolt 22 and provides a compressible layer between flange 36 and grate end 20.

During operation, rods 32 of devices 30 simply extend downward and rearward below the craft bottom and opening 12 and do not interfere with the flow of intake water. Water is sucked through opening 12 upwardly from below and horizontally from side locations, see arrows 19 near opening 12 in FIGS. 2 and 6. In shallow water with a sandy bottom, rod 32 flexes to ride on the bottom without breaking and flexes to assume the substantial unflexed position shown in FIG. 2 when the craft moves to deeper waters.

Figure 7:
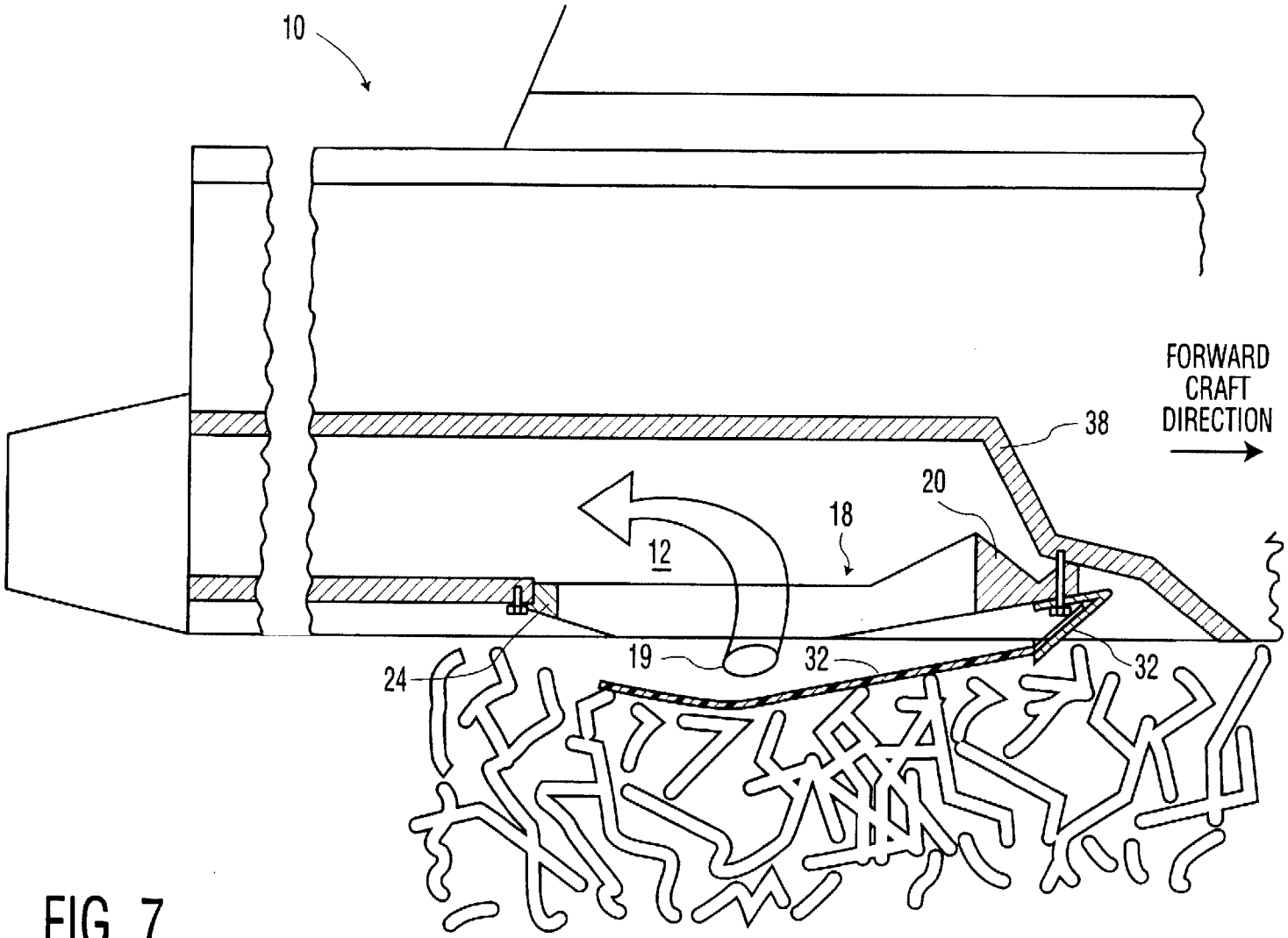
FIG. 7 is similar to FIG. 2 showing the intake section of the craft in operation and encountering weeds or grass.

When the craft encounters patches of floating grass or floating or growing weeds, the bow of the craft first flattens the tops thereof to a randomly extending positions in generally a horizontal plane. The upper, exposed parts of rods 32 then encounter the flattened or matted weeds or grass and presses them downward as the craft continues forward. Rod 32 flexes upward somewhat against the spring force which causes the suppression forces. As better seen in FIG. 7, when opening 12 and grate 18 are completely within the patch profile, the rods 32 have developed their maximum flexed spring or suppression force and the distal end tends to flex further than the rod 32 portion nearer the rod mount 34. This is caused by the suction at opening 12 tending to pull the flattened weeds or grass therethrough and the free end of rod 32 being allowed to flex in response to the weed pressure. Accordingly, the length of rods 32 are such that the weeds or grass suppression forces are sufficient to enable opening 12 to completely transcend the weeds or grass before the suppression forces of rods 32 are completely withdrawn from the weeds or grass. In addition, water intake, even if restricted by the weeds or grass from below, can still enter opening 12 from the side locations such as shown by arrows 19. This enhances the craft's ability to maintain power thrust and forward speed to clear the weeded or grassy area and avoid fouling the intake.

When the craft is beached, rod 32 simply flexes to the phantom position 46 shown in FIG. 1 and while the craft is dragged backward from the beach, rods 32 flex to phantom position 48 without damage to the craft or devices 30. Rod 32 would flex to position 48 when the craft is hoisted or stored on a flat surface.

Figure 8:
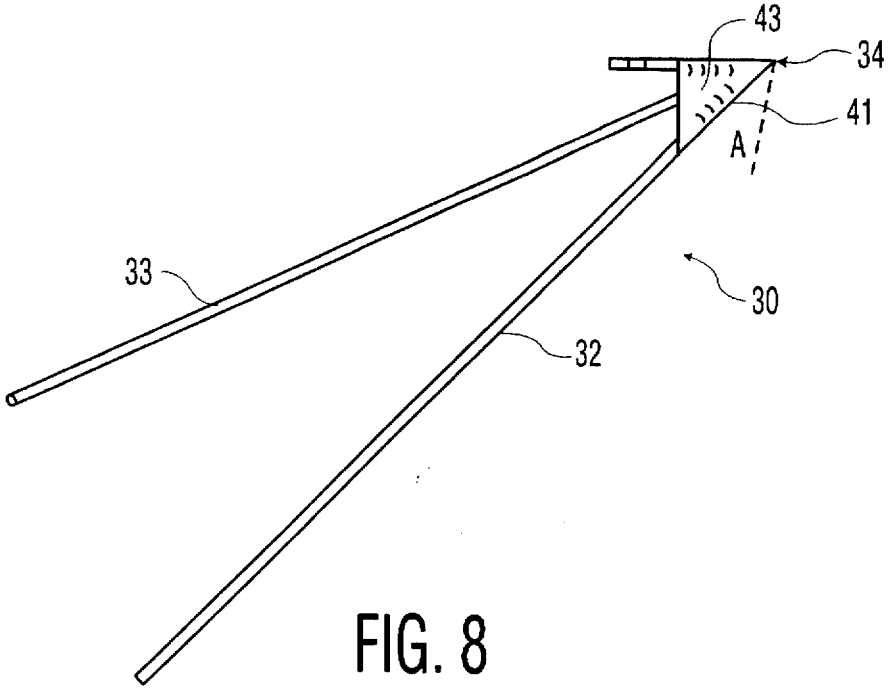
FIG. 8 is the same as FIG. 3 showing an alternate embodiment of the anticlogging device.
Figure 9:
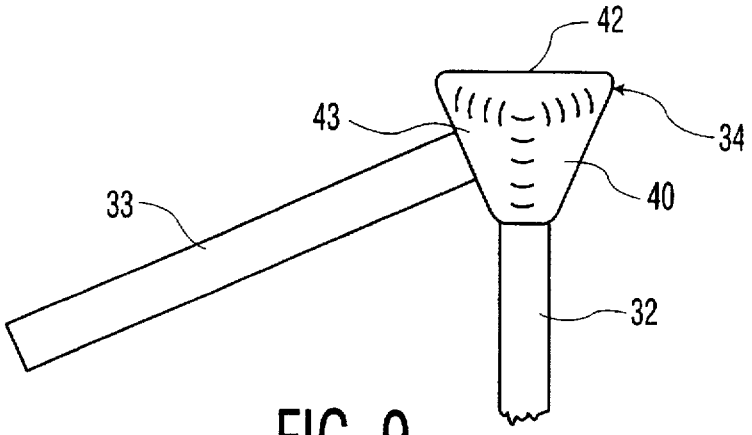
FIG. 9 is a partial front view of FIG. 8.
Figure 10:
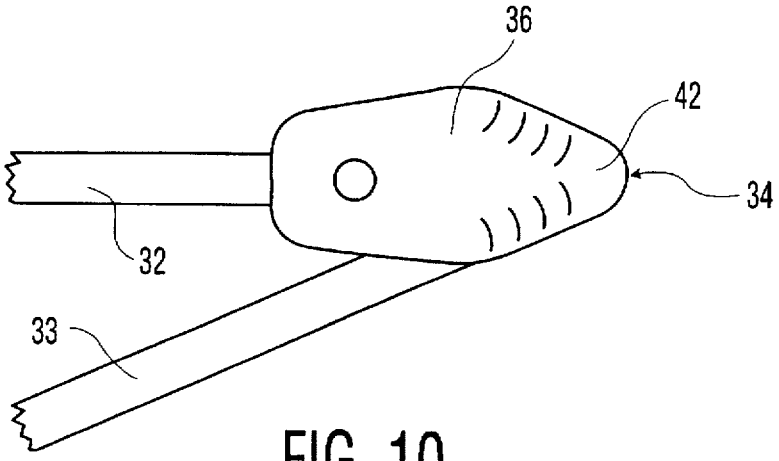
FIG. 10 is a partial top view of FIG. 8.

An alternate embodiment of device 30 is shown in FIGS. 8–10 in which a second flexible rod 33 is welded to the inner surface of the outer side wall 43 of each rod mount 34. Only the right side device 34 is shown, the left side device 34 (not shown) would be the mirror image of the right side device. Rods 33 function to urge encountered weeds or grass downward and outward away from intake opening 12 while rods 32 urge them downward. This embodiment produces greater assurance of lateral water flow intake such as indicated at arrows 19 than the embodiment of FIGS. 1–7, particularly when encountering extremely thick and large beds of floating grass or weeds.

Figure 11:
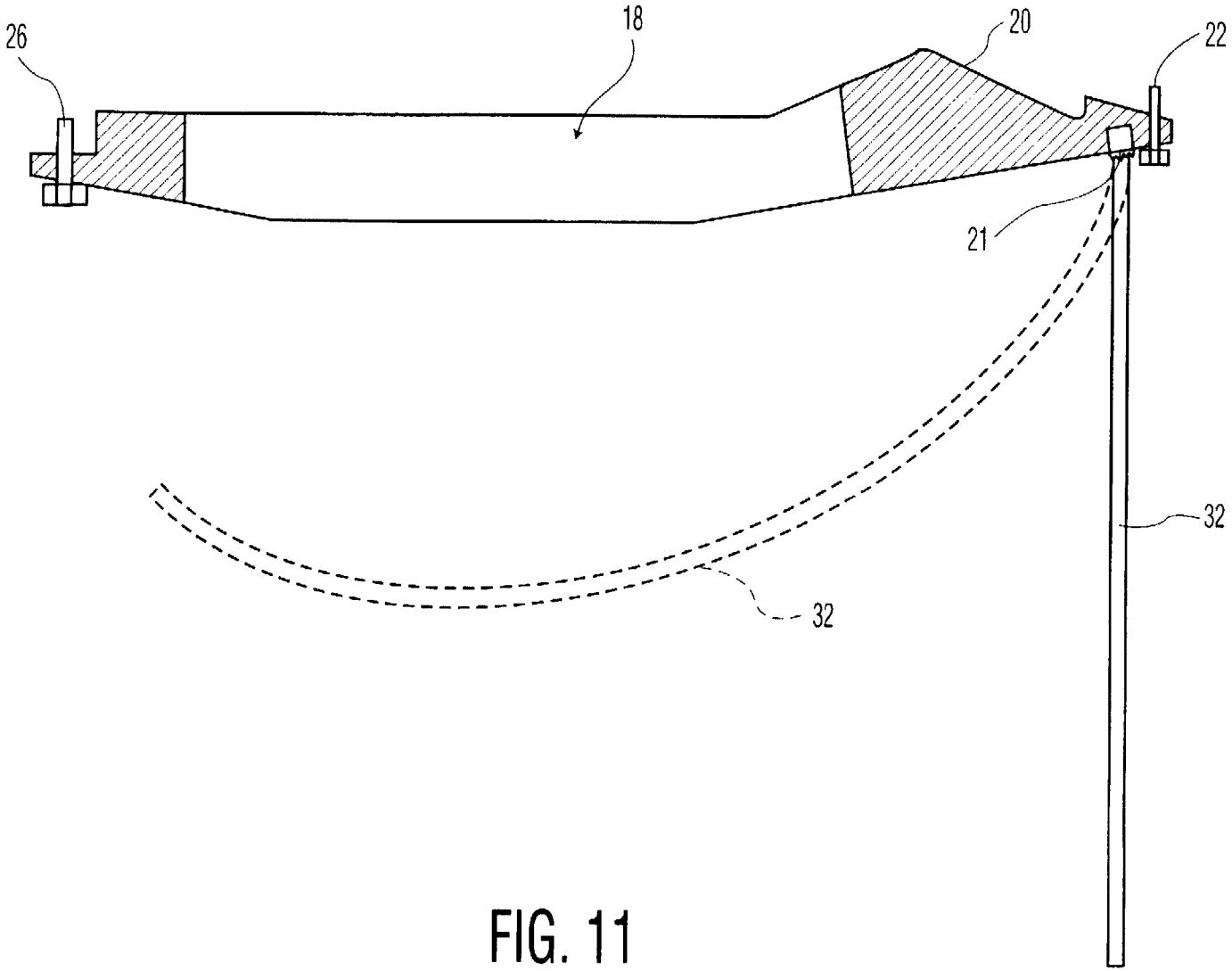
FIG. 11 is a side section similar to FIG. 2 showing only a further embodiment of the grate and anticlogging device according to the principles of the present invention.

Another exemplary embodiment of the anticlogging arrangement shown in FIG. 11 includes a pair of flexible rods 32 having their upper ends inserted into openings in grate 18 forward end 20 and welded thereto at 21. These rods depend generally vertically and flex to the phantom position shown when encountering weeds or grass during forward movement.

Figure 12:
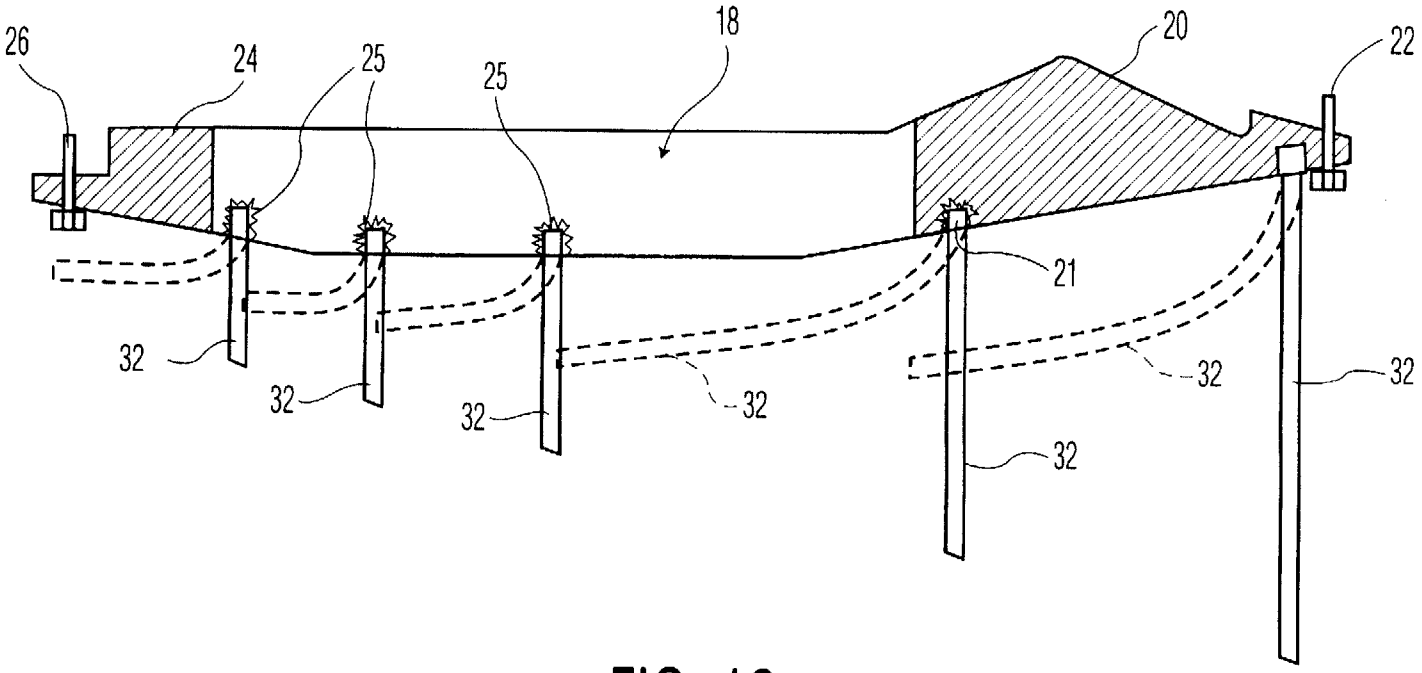
FIG. 12 is similar to FIG. 11 of yet another embodiment of grate and anticlogging device.

Yet another exemplary embodiment of the anticlogging arrangement shown in FIG. 12 includes a plurality of pairs of rods 32 some of which have their upper ends inserted into forward end 20 and welded at 21 and others simply welded at 25 to the sides of the baffles of grate 18. Rods 32 flex to assume the phantom positions shown when encountering weeds or grass.

Figure 13:
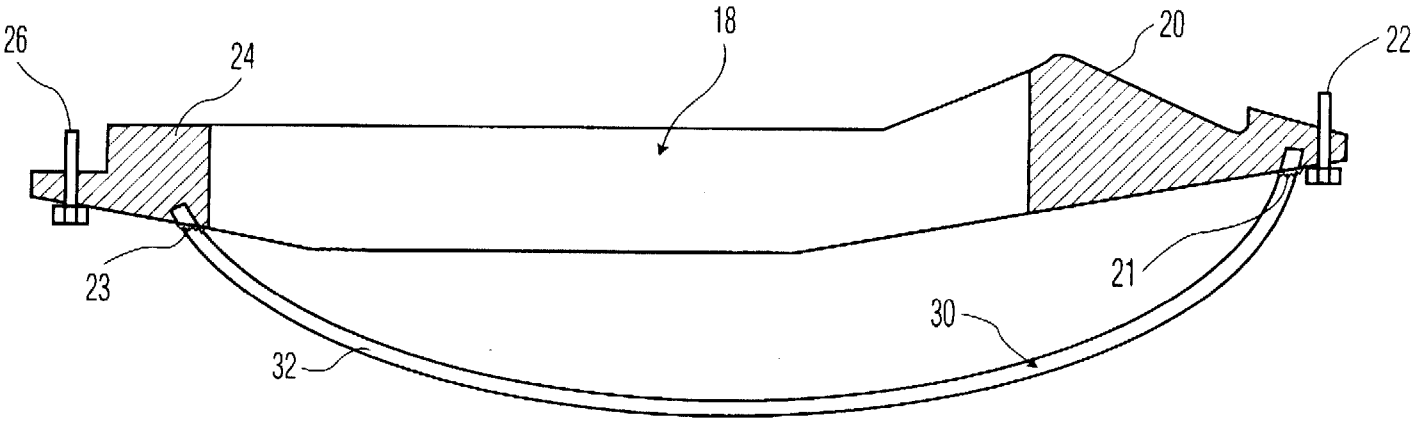
FIG. 13 is similar to FIG. 11 of still another embodiment of grate and anticlogging device.

Another exemplary embodiment of the anticlogging arrangement shown in FIG. 13 includes a grate 18 having the forward end of each flexible rod 32 inserted into an opening in the grate forward end 20 and welded at 21 and then aft end of rod 32 inserted into an opening in the after end 24 and welded thereto at 23. Rods 32 function as skids and suppress downward encountered weeds or grass as described above, however, with less vertical flexing of rods 32. Upon being beached or stored, rod 32 flexes laterally outward or inward instead of fore and aft as shown for the embodiment of FIG. 1.

Various modifications and changes can be made to the herein disclosed exemplary embodiments without departing from the spirit and scope of the present invention.

We claim:

1. A water jet craft comprising a hull having a water intake opening in the bottom portion of said hull and a water outlet substantially at the rear of said hull, a grate extending across the inlet opening, pump means for drawing water from near said intake and forcing water through said outlet to provide forward propulsion for the craft and to draw floating or growing grass or weeds near said inlet opening into said intake opening and within and beyond said grate, said craft characterized by:

at least one anticlogging device comprising at least one elongated, flexible member having a first end coupled to said hull substantially at the forward portion of said inlet and extending downward from said first end and below said grate for contacting and forcing downward from the bottom portion of said hull floating or growing weeds or grass thereby preventing the weeds or grass from being sucked into the intake and the grate and causing the weeds or grass to pass under and rearward of the water drawing action at said intake as the craft moves forward over the weeds or grass.

2. A craft according to claim 1 wherein said at least one elongated member has an unflexed position such that the downward force on the weeds or grass varies in response to the amount said elongated member is flexed rearward by the encountered weeds or grass.

3. A craft according to claim 2 wherein said elongated member when in an unflexed position extends downward and rearward from said hull bottom so that its substantially entire length is underneath said intake opening when in an unflexed position.

4. A craft according to claim 3 further comprising a mount having a first mount portion secured to the upper end of said elongated member and a second mount portion releasably coupled to the hull.

5. A craft according to claim 4 further comprising a spacer contacting said second portion for absorbing vibration and shock forces applied to said at least one of said hull and mount.

6. A craft according to claim 4 wherein said mount first portion includes a hollow section with side walls facing forward and an opening facing rearward and said elongated member upper end is secured within said section to at least one of said sidewalls and extends rearward through said opening.

7. A craft according to claim 4 wherein said grate extends longitudinally across said intake opening, said craft further including a releasable fastener fastening said second mount portion to the forward end of said grate and fastening said forward end of said grate to the bottom of said hull.

8. A craft according to claim 2 wherein said anticlogging device includes a second elongated, flexible member having a forward end mounted substantially at the forward end of said intake opening and extending rearward, downward and laterally outward from the forward end of said intake opening for contacting and forcing encountered weeds or grass laterally and downwardly away from the forward path of said intake opening.

9. A craft according to claim 1 wherein said grate extends longitudinally across said intake opening and comrpises a forward grate end and an aft grate end and at least one vertical baffle for blocking debris from the intake connected to said forward grate end and aft grate end, said elongated member having one end connected to said forward grate end and extending downward beneath said forward grate end.

10. A craft according to claim 9 wherein said elongated member has an unflexed position extending downward from its upper end and, in response to said elongated member encountering weeds or grass, a flexed position extending longitudinally below the intake opening and closer to the hull than when in the unflexed position.

11. A craft according to claim 10 further comprising at least two elongated members spaced longitudinally from each other and at least one of said at least two elongated members having its upper end connected to said baffle and having an unflexed position extending downward from said baffle and, in response to said elongated member contacting weeds or grass, a flexed position extending longitudinally below the intake opening and closer to the baffle than when in the unflexed position.

12. A craft according to claim 9 wherein said elongated member has a second end connected to said aft grate end and said elongated member is bowed in a position below said grate and intake opening.

13. A craft according to claim 2 wherein said elongated member is made of metal or an alloy of metal.

14. A craft according to claim 13 wherein said elongated member comprises a rod member.

15. A craft according to claim 14 wherein said rod member comprises a length of metal stranded cable.

16. A craft according to claim 2 wherein said at least one anticlogging device comprises two anticlogging devices spaced laterally from each other and each having an upper end coupled to said hull substantially at the forward end of said intake opening.

* * * * *